US010184444B2

(12) United States Patent
Plenk

(10) Patent No.: US 10,184,444 B2
(45) Date of Patent: Jan. 22, 2019

(54) METHOD FOR IMPROVING THE COLD START CAPACITY OF AN INTERNAL COMBUSTION ENGINE, AND CRANKCASE VENTILATING DEVICE FOR THIS PURPOSE

(71) Applicant: MTU Friedrichshafen GmbH, Friedrichshafen (DE)

(72) Inventor: Katejan Plenk, Lindau (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 130 days.

(21) Appl. No.: 15/106,685

(22) PCT Filed: Aug. 14, 2014

(86) PCT No.: PCT/EP2014/002257
§ 371 (c)(1),
(2) Date: Jun. 20, 2016

(87) PCT Pub. No.: WO2015/090483
PCT Pub. Date: Jun. 25, 2015

(65) Prior Publication Data

US 2017/0002784 A1 Jan. 5, 2017

(30) Foreign Application Priority Data

Dec. 20, 2013 (DE) ..... 10 2013 021 983

(51) Int. Cl.
*F02N 19/10* (2010.01)
*F01P 3/18* (2006.01)
(Continued)

(52) U.S. Cl.
CPC ..... *F02N 19/10* (2013.01); *F01M 13/04* (2013.01); *F01P 3/18* (2013.01); *F01P 5/12* (2013.01);
(Continued)

(58) Field of Classification Search
CPC .. F02N 19/10; F01M 13/04; F01P 5/12; F01P 3/18; F01P 7/16
See application file for complete search history.

(56) References Cited

U.S. PATENT DOCUMENTS 4,768,493 A * 9/1988 Ohtaka ..... F01M 13/00 123/545
6,415,778 B1 7/2002 Makino et al.
(Continued)

FOREIGN PATENT DOCUMENTS

DE 4136773 C1 12/1992
DE 102007016205 A1 10/2008
(Continued)

*Primary Examiner* — Jacob Amick
(74) *Attorney, Agent, or Firm* — Lucas & Mercanti, LLP; Klaus P. Stoffel

(57) ABSTRACT

A method for improving the cold start capacity of an internal combustion engine which is cooled with water that is pre-heated for the cold start. The pre-heated hot water is conducted through flow paths in a region of the crankcase ventilating device and/or in a water/air heat exchanger of the crankcase ventilating device. An internal combustion engine with at least one cooling water circuit, at least one cooling water pump which is arranged in the cooling water circuit, and at least one crankcase ventilating device. The crankcase ventilating device is at least temporarily integrated into the cooling water circuit of the internal combustion engine, and the cooling water circuit has a pre-heating assembly for pre-heating the cooling water when the internal combustion engine is cold started.

18 Claims, 4 Drawing Sheets

(51) Int. Cl.

| | |
|---|---|
| ***F01P 5/12*** | (2006.01) |
| ***F01P 7/16*** | (2006.01) |
| *F01M 13/04* | (2006.01) |
| *F01M 5/02* | (2006.01) |
| *F01P 5/10* | (2006.01) |
| *F01P 7/14* | (2006.01) |

(52) U.S. Cl.
CPC ..... *F01P 7/16* (2013.01); *F01M 5/02* (2013.01); *F01M 2013/0433* (2013.01); *F01M 2013/0455* (2013.01); *F01M 2013/0472* (2013.01); *F01P 2005/105* (2013.01); *F01P 2005/125* (2013.01); *F01P 2007/146* (2013.01); *F01P 2060/08* (2013.01)

(56) References Cited

U.S. PATENT DOCUMENTS

| | | | | |
|---|---|---|---|---|
| 7,077,224 | B2 | 7/2006 | Tomatsuri et al. | |
| 8,191,662 | B2 | 6/2012 | Sauvlet et al. | |
| 2007/0283927 | A1* | 12/2007 | Fukumoto ..... | F02M 31/125 123/445 |
| 2012/0291738 | A1 | 11/2012 | Hobart et al. | |
| 2013/0152881 | A1* | 6/2013 | Park ..... | F01P 3/20 123/41.31 |

FOREIGN PATENT DOCUMENTS

| | | | |
|---|---|---|---|
| DE | 102011103500 | A1 | 12/2011 |
| EP | 1130225 | A1 | 9/2001 |
| EP | 1382475 | A1 | 1/2004 |
| EP | 1965045 | A2 | 9/2008 |
| JP | H08246837 | A | 9/1996 |

* cited by examiner

METHOD FOR IMPROVING THE COLD START CAPACITY OF AN INTERNAL COMBUSTION ENGINE, AND CRANKCASE VENTILATING DEVICE FOR THIS PURPOSE

The present application is a 371 of International application PCT/EP2014/002257, filed Aug. 14, 2014, which claims priority of DE 10 2013 021 983.3, filed Dec. 20, 2013, the priority of these applications is hereby claimed and these applications are incorporated herein by reference.

BACKGROUND OF THE INVENTION

The invention relates to a method for improving the cold-start characteristics of a water-cooled internal combustion engine, the cooling water of which is pre-warmed for the cold start.

The invention also relates to an internal combustion engine having at least one cooling water circuit and at least one cooling water pump arranged in the cooling water circuit, and having at least one crankcase ventilation device.

Finally, the invention relates to a crankcase ventilation device for an internal combustion engine.

Crankcase ventilation devices of said type serve for the extraction, from the crankcase, of gases that have passed into the crankcase of an internal combustion engine of a motor vehicle owing to leaks between the cylinder walls and the pistons of the internal combustion engine, that is to say of blow-by gases, without the gases being conducted as emissions into the surroundings. Instead, said gases are admixed to the intake air, and the mixture of said gases with the intake air is supplied to the internal combustion engine. When the internal combustion engine is shut down, water may condense out, which water may precipitate in the crankcase ventilation device and be jointly drawn in upon restarting of the internal combustion engine.

The blow-by or crankcase gases contain water or moisture, which may freeze to form ice if the internal combustion engine or the motor vehicle is operated in an environment with temperatures close to or below the freezing point of water. Ice may form in the crankcase ventilation lines, and possibly also in the intake-air or charge-air line leading to the injection device or to the turbocharger of the internal combustion engine. Ice that is formed in the crankcase gas inlet may then impede, limit or even block the airflow in the crankcase gas inlet. This can give rise to a positive pressure in the crankcase. If ice particles detach and are entrained by the intake air, these can lead to blockage in an injection device or even to damage in a turbocharger, for example to compressor vanes, in a closely meshed arrangement, of the turbocharger.

One approach for reducing the formation of ice lies in the suitable material selection for a crankcase gas inlet connector. Such a solution is proposed in the document JP 8-246837. The inlet connector is produced from a material which exhibits low thermal conductivity, and from the surface of which ice easily detaches. Thus, moisture contained in the crankcase gas precipitates more in liquid form, for example in the form of water droplets, on the inlet connector. A disadvantage of this approach to a solution is that the thermal characteristics of the parts is also dependent on the shape and size thereof, and a functioning solution can be found only through numerous tests.

SUMMARY OF THE INVENTION

It is an object of the invention to specify a method for improving the cold-start characteristics of a water-cooled internal combustion engine, by means of which method it is possible in a simple and reliable manner to improve the cold-start characteristics. In particular, the method should also be implementable retroactively.

Furthermore, it is sought to propose an internal combustion engine with improved cold-start characteristics, and a crankcase ventilation device which does not give rise to any operational disruption even in the event of a cold start.

[A1] According to the invention, the cooling water utilized for the internal combustion engine is used for heating the crankcase ventilation device. The cooling water is turned into heating water. For this purpose, the cooling water is initially pre-warmed for the cold start, and the pre-warmed warm water is conducted through at least one flow path in a housing region and/or in a water/air heat exchanger of the crankcase ventilation device. Any ice that is formed in the crankcase ventilation device is melted to form water, which then does not have a damaging action and can be separated off.

[A2] In a refinement of the invention, it is provided that the warm water is extracted from a pre-warming unit of the internal combustion engine, preferably by incorporation into a cooling water circuit, the water of which is pre-heated during the cold start. Thus, there is no need for a separate pre-warming device for the warm water that is intended to heat the crankcase ventilation device. The heating of the crankcase ventilation device may be performed at the same time as preheating of the engine. There is then advantageously no need for additional electrical heating elements with associated control elements.

[A3] By virtue of the fact that a pre-warming branch for the crankcase ventilation device is connected as a bypass line with respect to a flow path of the cooling water circuit, the branch can be shut off also independently of the cooling water circuit when a desired setpoint temperature is reached.

[A4] The heating time of the crankcase ventilation device can advantageously be reduced if the warm water is conducted through a water/air heat exchanger in an oil separation region and/or a filter region of the housing of the crankcase ventilation device. In relation to heating of the housing, this solution has the advantage that the size of the heat exchanger surface can be structurally larger, and thus the pre-warming time is reduced. Furthermore, a heat exchanger of said type may also be retrofitted, as a separate component, in the case of existing internal combustion engines, for example by being designed as a component that can be plugged onto the housing of the crankcase ventilation device or onto the provided oil separator.

[A5] The pre-warming time may furthermore advantageously be reduced if the warm water supply to the crankcase ventilation device is stopped when a certain temperature is reached, preferably by virtue of the warm water being conducted past the crankcase ventilation device or by virtue of the supply of warm water being stopped.

[A6] The device-related object is achieved, in the case of an internal combustion engine having at least one cooling water circuit and at least one cooling water pump arranged in the cooling water circuit, and having at least one crankcase ventilation device, in that the crankcase ventilation device is at least temporarily incorporated into the cooling water circuit of the internal combustion engine, wherein the cooling water circuit preferably has a pre-warming unit for preheating the cooling water during a cold start of the internal combustion engine. It is basically also possible for the crankcase ventilation device to be incorporated into a cooling water circuit of a charge-air cooler. The incorporation into the cooling water circuit has the advantage that no separate heating means has to be provided. However, suitable connectors must be found.

[A7] In a refinement of the internal combustion engine, it is provided that at least one flow path for the cooling water, for example cooling water ducts, are provided in the wall of the crankcase ventilation device. These can be easily provided as flow paths in the cast housing of the crankcase ventilation device, without the costs of the cast part being significantly increased. Retrofitting of the internal combustion engine is possible if the housing is exchanged for one with cooling water ducts.

[A8] Particularly direct heating is realized if, in the crankcase ventilation device, there is arranged a water/air heat exchanger with at least one cooling water duct as a flow path for the cooling water.

[A9] The pre-warming can be deactivated independently of pre-warming of the engine or charge-air cooler, because, in parallel with respect to the flow path of the cooling water, a bypass is provided to the pre-warming device for the crankcase ventilation device, which bypass is designed to open when a certain cooling water temperature is exceeded.

[A10] The measure whereby a temperature-controlled valve, preferably with a bimetal actuator, is arranged in the bypass serves for this purpose. Alternatively, a valve with a wax cartridge may also serve for this purpose. The advantages of such mechanically actuated valves lie in their simple and proven type of construction, which can be expected to operate reliably and requires no additional intervention into the electrical circuits of the engine controller.

[A11] If the internal combustion engine has an engine block which has a cooling water outlet opening and a cooling water inlet opening, to which a feed line of the pre-warming device and a return line of the crankcase ventilation device can be connected, a heat exchanger for the crankcase ventilation device can be connected in a particularly convenient manner, because no additional bores are required.

[A12] In a further refinement of the internal combustion engine, it is proposed that the cooling water outlet opening and/or the cooling water inlet opening in the engine block for the feed line and/or the return line of the pre-warming device of the crankcase ventilation device are arranged on a cooling water permanent ventilation means and/or on a water-conducting housing of a pre-warming connector of the engine block. This measure requires the least outlay in terms of modification, and advantageously requires little structural space and short flow paths, because the engine block in any case normally has multiple openings for the cooling water permanent ventilation means. The water-conducting housing of the engine block is also particularly well-suited to the connection because it normally has openings equipped with blanking plugs, which openings can be utilized to particularly advantageous effect because no intervention in the engine block is necessary.

[A13] The device-related object is finally also achieved by way of a crankcase ventilation device for an internal combustion engine in that the crankcase ventilation device has at least one warm-water inlet and one warm-water outlet and at least one interposed flow path for warm water, wherein the at least one flow path is preferably in the form of a primary side of a water/air heat exchanger.

[A14] It is advantageously provided, for a refinement of the crankcase ventilation device, that the water/air heat exchanger is arranged in or at an oil separation region of the housing of the crankcase ventilation device. The cross sections are often small in said region. Ice can thus have a particularly damaging effect in said region. The water/air heat exchanger is particularly effective in said region. At the same time, said region is also the most easily accessible, such that the installation process is thus advantageously simplified.

[A15] In a further advantageous refinement of the crankcase ventilation device, it is proposed that, in the flow path, there is arranged at least one valve which is designed to be closed by a temperature-actuated actuator when a threshold temperature is exceeded. The pre-warming of the crankcase ventilation device is thus advantageously made independent of pre-warming of the engine block or of a charge-air cooler. When a threshold temperature is reached, the pre-warming is ended by virtue of the valve being closed. The power of the pre-warming unit is then available entirely to the engine block or to the charge-air circuit.

A preferred embodiment of the invention will be discussed by way of example on the basis of a drawing. In detail, in the figures of the drawing:

DETAILED DESCRIPTION OF THE INVENTION

Figure 1:
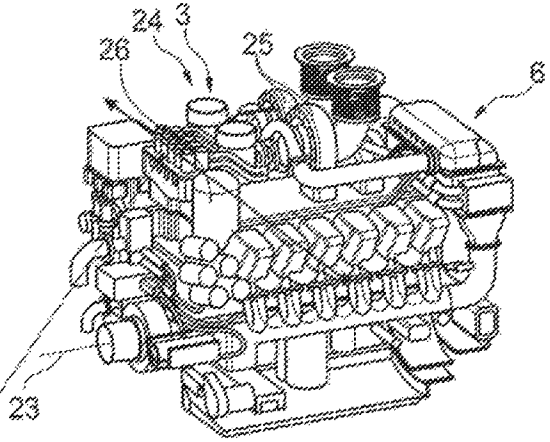
FIG. 1 shows a perspective view of a known internal combustion engine having a crankcase ventilation device according to the invention.

For orientation, FIG. 1 illustrates a known internal combustion engine in the form of an engine 24 with 12 cylinders. It is possible to clearly see the drive output axis 23 of the engine 24. On the top of the engine 24 it is possible to see two turbochargers 25. Transversely with respect to the orientation of the drive output axis 23, it is possible, at the top, to see a crankcase ventilation device 3; this is partially concealed by an oil filter 26.

Figure 2:
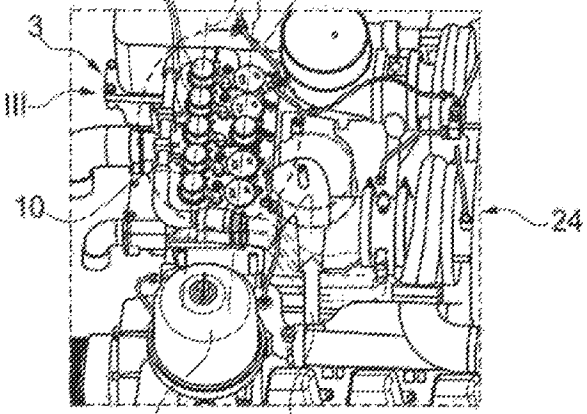
FIG. 2 shows a perspective detail view of the internal combustion engine illustrated in FIG. 1, with crankcase ventilation device.

FIG. 2 shows the crankcase ventilation device 3, which is not clearly visible in FIG. 1, in more detail. Behind the oil filter 26, in two parallel rows 27 oriented perpendicular to the drive output axis 23, it is possible to see two horizontal rows with spaces for in each case five oil separators 19. Four oil separators 19 are missing in the right-hand row 27.

Figure 3:
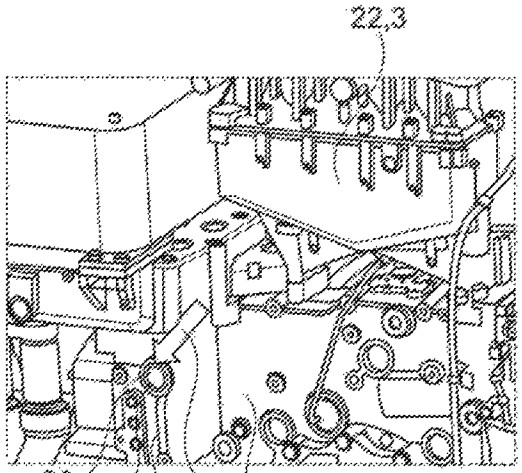
FIG. 3 shows a perspective detail view of the internal combustion engine illustrated in FIG. 1, with crankcase ventilation device and with a part of the engine block.

FIG. 3 shows a detail view of the engine 24 as per arrow III in FIG. 2. In this illustration, it is possible to clearly see the housing 22 of the crankcase ventilation device 3. Furthermore, on the monitor 28, there is provided an opening 30 denoted by arrow 29, which opening is equipped with a blanking plug, and the function of which will be discussed in conjunction with FIG. 6.

Figure 4:
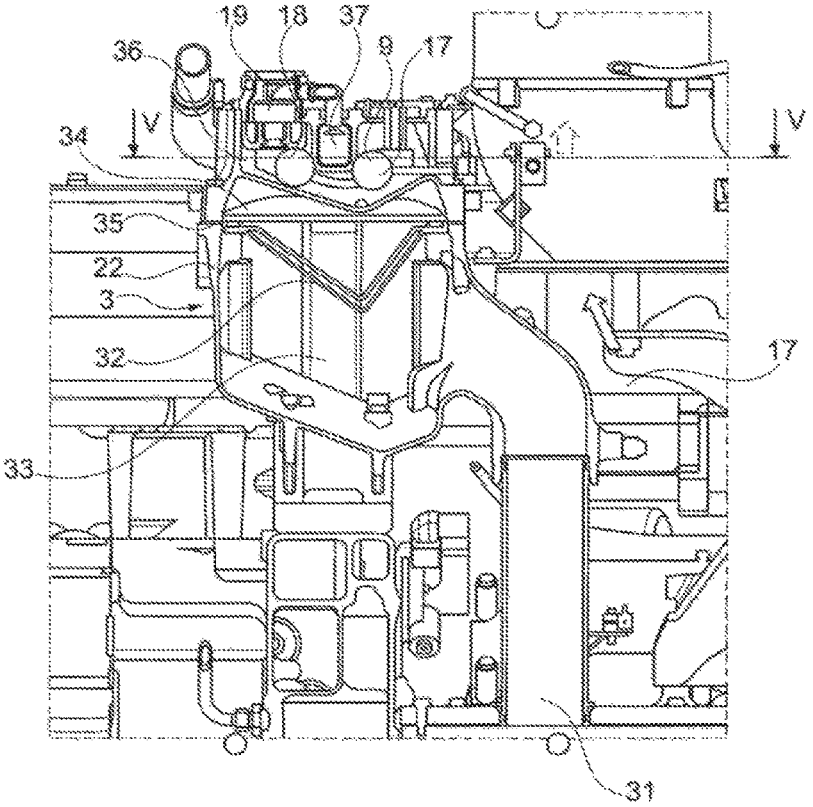
FIG. 4 shows a vertical section through a crankcase ventilation device according to the invention, sectioned transversely with respect to the line of oil separators.

FIG. 4 shows a vertical section through a crankcase ventilation device 3 according to the invention, the section plane of which is oriented transversely with respect to the row of oil separators. A crankcase ventilation line 31 leads vertically from below into the cast housing 22 of the crankcase ventilation device. In the housing 22 there is situated a perforated sheet-metal part, bent at right angles, as an oil pre-separator 32 which divides the housing 22 into a lower part 33 and an upper part 34. Said two parts 33, 34 are joined at the parting joint 35 in order to form the housing 22. Above this, as an integral constituent part of the housing part 34, there is situated an oil separator volume 36 and, in the latter, there is situated a a feed line 17 and a return line 18 of a water/air heat exchanger 9 for warming the oil separator volume 36, and an interposed clean-air manifold 37. After passing through the oil separator 19, the air, which has had oil removed from it, from the crankcase is merged in the clean-air manifold 37 and conducted to the turbochargers 25 (FIG. 1).

Water may also accumulate in the oil separator volume 36, which water may freeze in the presence of low temperatures. According to the invention, to prevent formation of ice, a water/air heat exchanger 9 is provided in the oil separator volume 36, which water/air heat exchanger is, in this illustration, illustrated as two sectioned lines, specifically feed line 17 and return line 18. Extending from below, it is possible to see the feed line to the air heat exchanger 9. The return line is not illustrated in this view. The cross sections of the air/water heat exchanger 9 advantageously bear closely against the wall of the clean-air manifold 37 in order to permit more intensive exchange of heat. Any formation of ice in the clean-air manifold is thus likewise prevented in an effective manner.

Figure 5:
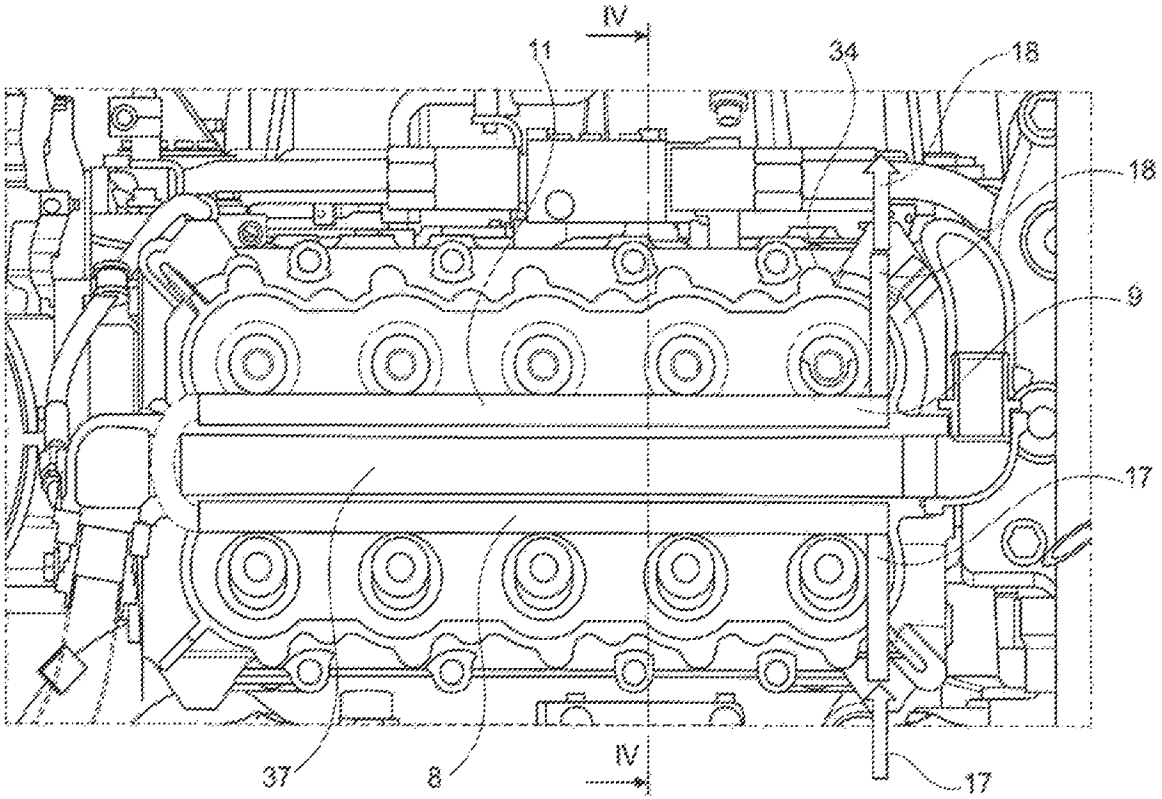
FIG. 5 shows a horizontal section through a crankcase ventilation device according to the invention, sectioned at the level of the oil separators.

The form of the air/water heat exchanger 9 can be seen more clearly in FIG. 5. FIG. 5 shows a horizontal section through a crankcase ventilation device 3 according to the invention, wherein the section through the upper housing part 34 with the oil separator volume 36 passes approximately centrally through the clean-air manifold 37. The water/air heat exchanger 9 is in the form of a horizontal U shape, on the free limbs of which a feed line 17 and a return line 18 permit the flow through the air/water heat exchanger 9. Here, a part of the circumferential surface of the flow path 8 bears closely against the profile of the clean-air manifold 37, and thus permits intensive heat transfer into the clean-air manifold 37 from the water flowing through the flow path 8.

The water for the feed line 17 is advantageously extracted from a cooling water outlet opening 15 (FIG. 2). Opening 30 (FIG. 3) of the engine block 28 can be utilized for the connection of the return line 18. It is thus merely necessary to remove the plug in order to connect the feed line 17 to the cooling water circuit 1 (FIG. 6) of the engine 24.

Figure 6:
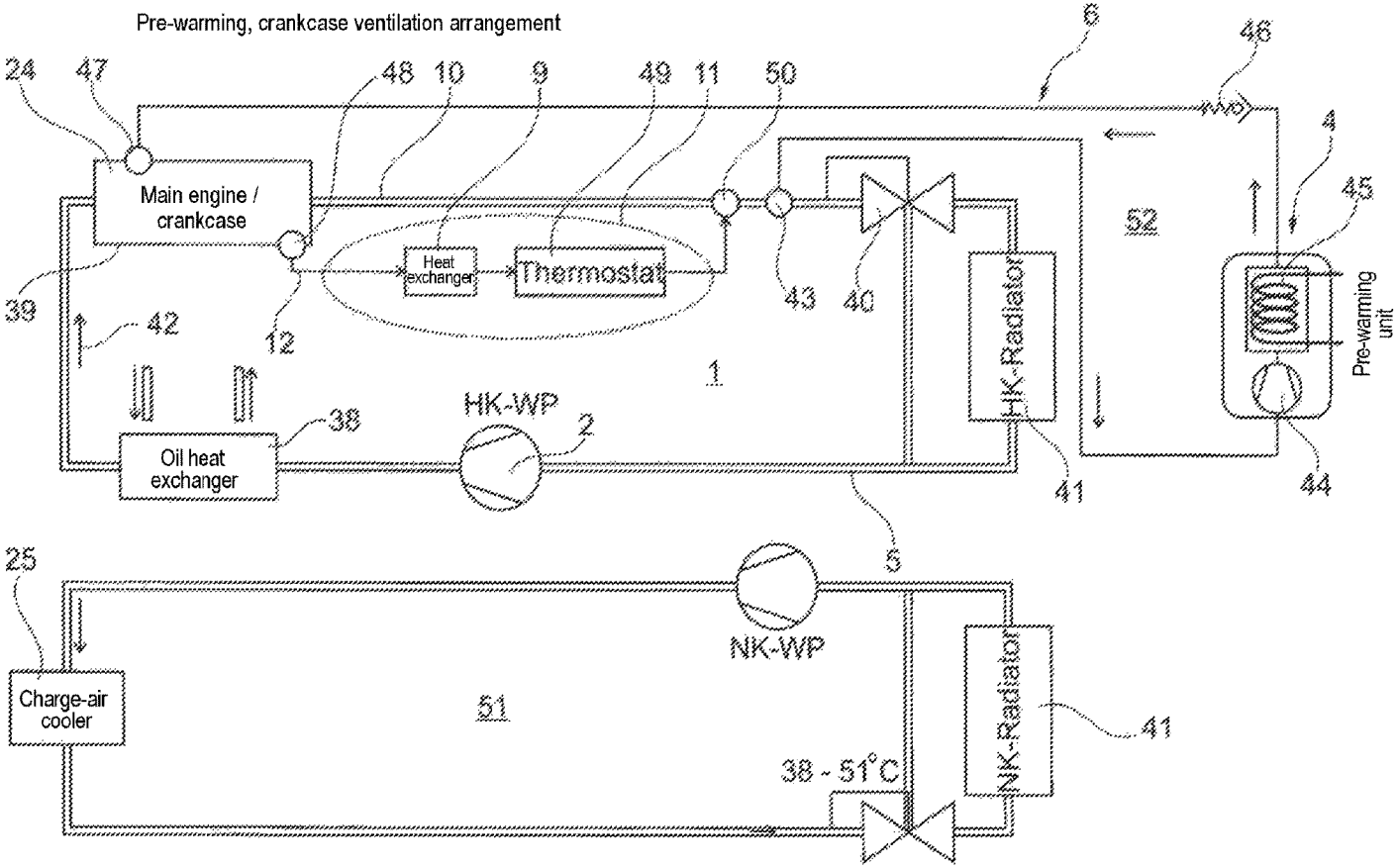
FIG. 6 shows, at the top, a pipeline schematic for the cooling water circuit of the engine of an internal combustion engine according to the invention, and at the bottom, a pipeline schematic for the cooling water circuit of a charge-air cooler.

The interconnection of the water/air heat exchanger 9 is schematically illustrated in FIG. 6. The cooling water circuit 1 of the engine 24 is composed substantially of a cooling water pump 2, an oil heat exchanger 38, the engine block 39 of the engine 24, a thermostat valve 40, and a radiator 41, through which the cooling water 5 flows in the stated sequence, that is to say in the direction of the arrow 42.

To permit a cold start of the engine, a pre-warming unit 4 is additionally provided which extracts cooling water at a suitable point 43 and, by way of a driven, separate pump 44, conducts said cooling water through a heating device 45 and through a flow direction valve 46 back into the engine block 39 at a feed opening 47. The pump 44 is electrically driven, whereas the pump 2 is driven by the engine itself after starting of the engine.

To improve the cold-start characteristics of the internal combustion engine 6, a pre-warming device 11 is provided which extracts cooling water at a ventilation opening 48 of the engine block 39, conducts said cooling water via the water/air heat exchanger 9, and, in a manner controlled by the thermostat 40, recirculates said cooling water back to the cooling water circuit 1 at a point 50. Thus, the pre-warming device 11 forms a bypass 12 with respect to the flow path 10, between the ventilation opening 48 and the point 50. As a thermostat valve, use may be made of valves with known, thermally controlled actuators, such as valves electrically activated by sensors, or valves with bimetal actuators or with wax cartridges as actuators.

The cooling water circuit 1 is at a higher temperature level than the further cooling water circuit 51 for the charge-air cooler 25, which is illustrated at the bottom in FIG. 6. The cooling water circuit 51 of the charge-air cooler 25 is interconnected in a fundamentally analogous manner to the cooling water circuit 1.

The pre-warming device 11 may analogously also be provided in the cooling water circuit 51 of the charge-air cooler 25, if said cooling water circuit 51 is also equipped with a pre-warming unit 4 or is jointly incorporated into the pre-warming water circuit 52 of the pre-warming unit 4. Instead of the water being extracted at a cooling water ventilation opening 48, the water may also be extracted at any desired point downstream of the flow direction valve 46.

While at least one exemplary embodiment has been illustrated in the above description, it should be understood and observed that a large number of variations or modifications in relation to these exist. It should also be observed that the exemplary embodiment or the exemplary embodiments are merely examples and are not intended to limit the scope or scope of protection, the applicability or the construction of the device according to the invention in any way. Rather, the abstract and the detailed description provide a person skilled in the art with sufficient and easily understandable instructions for implementing at least one exemplary embodiment.

Here, it should be understood that numerous and various modifications to said embodiment with regard to the function and the arrangement of the elements described in an exemplary embodiment may be made without departing from the scope or scope of protection defined by the appended patent claims and by the legal equivalents thereof.

The invention claimed is:

1. A method for improving cold-start characteristics of a water-cooled internal combustion engine, in which engine cooling water is pre-warmed for cold starting, the method comprising conducting the pre-warmed warm water through at least one flow path in a housing of a crankcase ventilation device and/or through a U-shaped water/air heat exchanger provided in the housing so that legs of the U-shape are closely against a clean-air manifold.

2. The method according to claim 1, including extracting the warm water from a pre-warming unit of the internal combustion engine.

3. The method according to claim 2, wherein the pre-warming unit is incorporated in a cooling water circuit, the water of the cooling water circuit being pre-heated during the cold start.

4. The method according to claim 1, wherein the pre-warming branch is connected as a bypass line with respect to a flow path of the cooling water circuit.

5. The method according to claim 1, including conducting the warm water through the water/air heat exchanger in an oil separation region and/or a filter region of the housing of the crankcase ventilation device.

6. The method according to claim 1, including stopping the warm water supply to the crankcase ventilation device when a defined temperature is reached.

7. The method according to claim 6, including stopping the warm water supply by conducting the warm water past the crankcase ventilation device.

8. An internal combustion engine, comprising: at least one cooling water circuit; at least one cooling water pump arranged in the cooling water circuit; at least one crankcase ventilation device, wherein the crankcase ventilation device is at least temporarily incorporated into the cooling water circuit, wherein the cooling water circuit includes a pre-warming unit for preheating the cooling water during a cold start of the internal combustion engine, the pre-warming unit including a U-shaped water/air heat exchanger provided so that legs of the U-shape are closely against a clean-air manifold.

9. The internal combustion engine according to claim 8, wherein at least one flow path for the cooling water is provided in a wall of the crankcase ventilation device.

10. The internal combustion engine according to claim 8, wherein the water/air heat exchanger is arranged in the crankcase ventilation device, the water/air heat exchanger having cooling water ducts as flow paths for the cooling water.

11. The internal combustion engine according to claim 8, wherein, in parallel with respect to a flow path of the cooling water, a bypass is provided to the pre-warming unit for the crankcase ventilation device, the bypass being openable when a defined cooling water temperature is exceeded.

12. The internal combustion engine according to claim 11, wherein a temperature-controlled valve is arranged in the bypass.

13. The internal combustion engine according to claim 12, wherein the temperature-controlled valve includes a bimetal actuator.

14. The internal combustion engine according to claim 8, further comprising an engine block having a cooling water outlet opening and a cooling water inlet opening, to which a feed line and a return line of the pre-warming device of the crankcase ventilation device are connected.

15. The internal combustion engine according to claim 14, wherein the cooling water outlet opening and/or the cooling water inlet opening for the feed line and/or the return line of the pre-warming device of the crankcase ventilation device are connected to a cooling water permanent ventilation and/or to a water-conducting housing of the engine block.

16. A crankcase ventilation device for an internal combustion engine according to claim 8, the crankcase ventilation device comprising has at least one warm-water inlet and one warm-water outlet and at least one interposed flow path for warm water, wherein the at least one flow path is a primary side of the water/air heat exchanger.

17. The crankcase ventilation device according to claim 16, wherein the water/air heat exchanger is arranged in or at an oil separation region of a housing of the crankcase ventilation device.

18. The crankcase ventilation device according to claim 16, wherein at least one valve is arranged in the flow path, the valve being closed by a temperature-actuated actuator when a threshold temperature is exceeded.

* * * * *